United States Patent [19]

Petersik

[11] 4,084,928

[45] Apr. 18, 1978

[54] SLIP FORM HAVING REINFORCEMENT ACCOMMODATING MEANS

[75] Inventor: Adolph R. Petersik, Oklahoma City, Okla.

[73] Assignee: CMI Corporation, Oklahoma City, Okla.

[21] Appl. No.: 738,349

[22] Filed: Nov. 3, 1976

[51] Int. Cl.[2] ..... B28B 13/04; B28B 23/06

[52] U.S. Cl. ..... 425/64; 404/100; 404/105; 425/114

[58] Field of Search ..... 425/59, 63–65, 425/114, 122, 219, 432, 456; 404/96–98, 100, 105; 264/33–35

[56] References Cited

U.S. PATENT DOCUMENTS

| | | | |
|---|---|---|---|
| 3,200,177 | 8/1965 | Dodd | 425/114 |
| 3,600,773 | 8/1971 | Davis et al. | 425/63 |
| 3,657,977 | 4/1972 | Hudis | 404/100 |
| 3,792,133 | 2/1974 | Goughnour | 425/64 |
| 3,957,405 | 5/1976 | Goughnour | 425/63 |

*Primary Examiner*—Francis S. Husar
*Assistant Examiner*—John McQuade
*Attorney, Agent, or Firm*—Dunlap, Codding & MCCarthy

[57] ABSTRACT

An improved barrier forming apparatus and method whereby a barrier is formed continuously over a surface, the barrier having continuous reinforcing rods extending the length of the barrier and having cage reinforced standard supports at predetermined intervals along the length of the barrier. An improved barrier forming assembly is disclosed comprising a concrete forming member having a form cavity extending therethrough; a concrete passing member having a concrete delivery opening for passing concrete or the like to the form cavity; and a positioning assembly comprising a support shaft and a door member pivotally supported at a forward end of the concrete forming member, the barrier being extrudable continuously via the form cavity from a rearward end of the concrete forming member. The door member selectively is positionable to partially seal the form cavity at the forward end of the concrete forming member and has rod clearance channels through which the reinforcing rods pass through the door member into the form cavity when the door member is so positioned to seal the form cavity. The rod clearance channels permit the door member to clearingly pass the reinforcing rods to open the form cavity at the forward end of the concrete forming member to allow the free passage of the barrier forming assembly over the cage reinforced standard supports.

4 Claims, 8 Drawing Figures

SLIP FORM HAVING REINFORCEMENT ACCOMMODATING MEANS

BACKGROUND OF THE INVENTION

1. Field of the Invention

The present invention relates to apparatus for forming continuously extending barriers and the like, and more particularly, but not by way of limitation, the present invention relates to the continuous forming of barriers and the like over continuous reinforcing rods and over reinforced standard supports and the like at predetermined intervals along the length of the barrier.

2. Description of the Prior Art

A continuous median disposed to separate traffic lanes on an interstate highway is an example of a barrier of the type under consideration in the present invention. Such barriers are usually reinforced with one or more reinforcing rod extending the length of the barriers, and the construction of rod reinforced barriers is known in the art.

The patent to Smith, U.S. Pat. No. 3,779,662, assigned to the assignee of the present invention, discloses a curb slip form apparatus of the type used to extrude a predetermined, formed configuration. The Smith patent discusses the formation of curb shaped forms, and reference to the Smith patent is made for the purpose of general background material.

In usual practice, a concrete forming member having a predetermined transverse profile is formed in the manner discussed in the Smith patent. Continuous reinforcing rods are positioned along the planned path over which the continuous barrier is to pass, and a positioning means is provided to elevate the reinforcing rods to assume predetermined positions relative to the forming member as the forming member is moved along the path by the Smith apparatus, the barrier being extruded from a rearward end of the barrier forming apparatus.

The forming of a continuous barrier as taught in the Smith patent has proved to be very successful. However, a new type of barrier has recently come into being that presents a new difficulty in the formation of continuous barriers. Specifications for median barriers in many locales require the support of devices such as lighting support members, commonly referred to as standards, at predetermined intervals along the path of the barrier. That is, it is desirable that the barrier be constructed so that light standards and the like can be supported by the barrier at intervals along the barrier. Extra reinforcement in the form of cage reinforcing supports are formed along the path of the barrier where the light standards are to be supported.

It has been the usual procedure to use a concrete forming member to form the reinforced barrier, leaving interrupted open areas of a few feet in length along the barrier, and to construct reinforcing cages in these open areas. That is, each of the intervals that is left in the formed barrier is from 4 to 6 feet in length, and a reinforcement cage is constructed within this interval after the barrier has been machine formed. Upon completion of the placement of the extra reinforcement, and after placing appropriate electrical conduits, the barrier is hand completed by forming concrete or the like over the reinforcement cage to complete the barrier.

SUMMARY OF THE INVENTION

The present invention provides apparatus for continuously forming a concrete barrier or the like over a surface wherein the barrier has continuous reinforcing bars extending the length of the barrier and, also, wherein the barrier has cage reinforced standard supports spaced along the barrier at predetermined intervals. The present invention eliminates the requirement of hand finishing certain portions of barriers that are constructed with reinforcement members that have previously required hand finishing.

Accordingly, it is an object of the present invention to provide an improved barrier forming apparatus for the continuous forming of concrete barriers and the like having caged reinforced standard supports or the like disposed at intervals along the length of the barrier.

Another object of the present invention is to provide an improved apparatus for continuously forming a reinforced barrier having spaced apart reinforcement cages without the necessity of hand forming portions thereof.

Other objects, advantages and features of the present invention will become clear from the following detailed description of the preferred embodiment of the invention when read in conjunction with the drawings and appended claims.

DESCRIPTION OF THE PREFERRED EMBODIMENT

Figure 1:
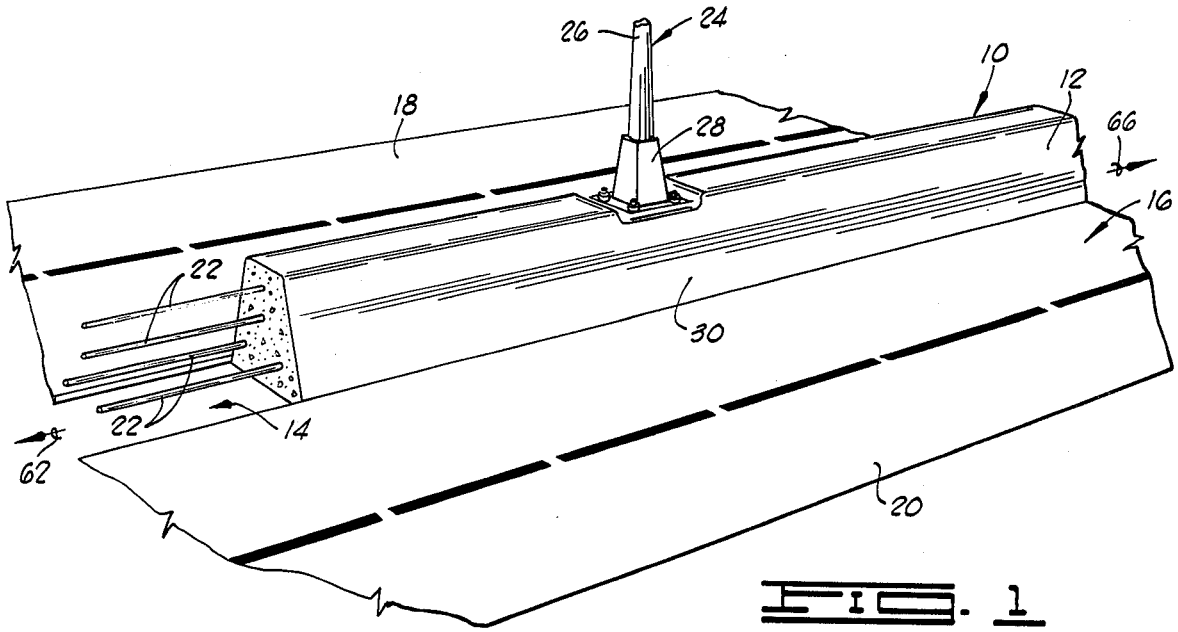
FIG. 1 shows a section of a reinforced median barrier constructed in accordance with the present invention.

Referring now to the drawings in general and to FIG. 1 in particular, shown therein and designated by the general reference number 10 is a section of a typical reinforced barrier. The barrier 10 comprises a formed configuration 12 of a concrete material or the like on a surface 14 and, as illustrated in FIG. 1, a paved highway 16 is laid over the surface 14 contiguously to the barrier 10 so that the barrier 10 serves as a traffic barrier between the highway lanes 18 on one side of the barrier 10 and the highway lanes 20 on the other side thereof. It is, of course, not essential to the present invention that the surface 14 be paved or that paved lanes be provided therewith.

Extending longitudinally through the barrier 10 and incorporated therein are several reinforcing rods 22. While four such reinforcing rods 22 are shown, it will be understood that any number of such rods may be specified and that the present invention is not restricted or limited to any particular number of rods. These rods serve to add strength to the barrier 10, and other types of reinforcing structure may also be incorporated as required.

Figure 4:
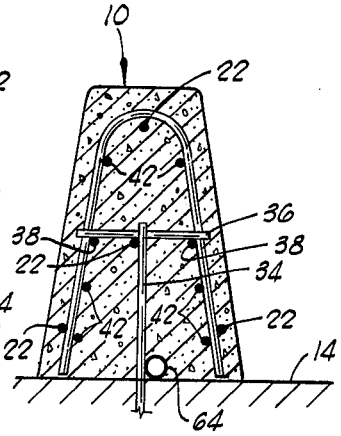
FIG. 4 is a cross-sectional view taken at 4-4 in FIG. 2.

Also shown in FIG. 1 is a lighting support member 24, commonly called a standard, that is supported by the barrier 10, the standard 24 comprising a pole 26 and a base 28 that is bolted to the barrier 10 in a manner that will be made clear below. A light or the like may be supported by the upper end (not shown) of the pole 26. The support of the light standard 24 requires that additional reinforcement be provided by the barrier immediately beneath the standard 24, and this will now be discussed with reference to FIGS. 2 through 4.

Figure 2:
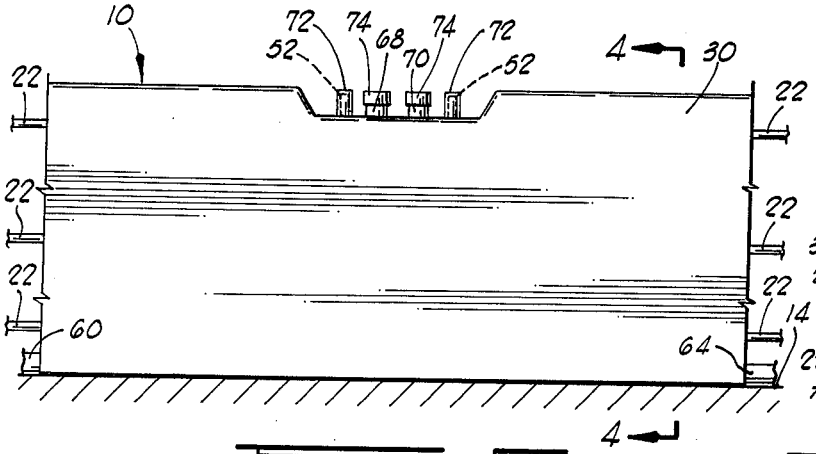
FIG. 2 is a side elevational view of a portion of a median barrier such as shown in FIG. 1 but showing the formed cage reinforced standard support following the formation thereof but prior to mounting the light standard.
Figure 3:
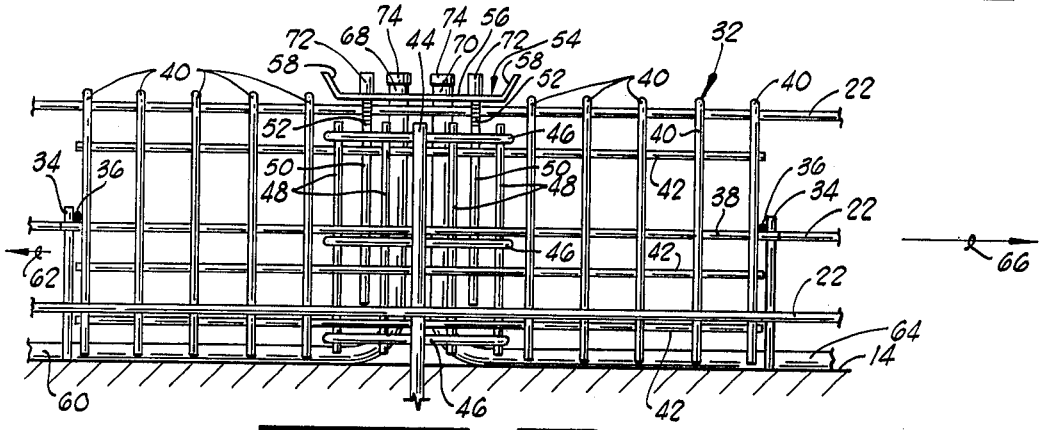
FIG. 3 shows a cage reinforced standard support prior to being covered by the forming material of the barrier.

FIG. 2 is a side elevational view of a standard supporting section 30 of the barrier 10 that is reinforced to support the standard 24, with the view shown prior to the laying of the highway 16. FIG. 3 is a view of the same section 30 shown in FIG. 2 without the concrete material formed thereabout. That is, FIG. 3 shows a reinforcement cage assembly 32 that has been provided in line with the formed configuration 12 as has been discussed generally above and which will be discussed more fully below. It has been customary to form the barrier 10 by positioning the endless reinforcing rods 22 over the desired path for the barrier 10, and then to make the formed configuration 12 via prior art slip form techniques, leaving spaces at predetermined intervals for the construction of the standard sections 30.

While the specific make up of the reinforcement cage 32 is not critical to the present invention, a typical cage assembly is represented in FIG. 3 and will be described more fully. A vertically extending support member 34 is anchored in and extends from the surface 14 at each end of the cage assembly 32, and a cross member 36 is attached thereto, as can best be viewed in the cross sectional view of FIG. 4. Attached to the cross members 36 is a pair of generally horizontally extending members 38 that serve to support a plurality of inverted V-shaped members 40. Additional horizontal members 42 are also provided and are attached to the members 40. Additional reinforcement immediately below the position of the standard 24 is provided by a vertically extending support post 44 that is anchored in and extends from the surface 14. Several horizontal loop members 46 are attached to the support post 44, and the members 46 in turn support several vertical members 48 at spaced apart intervals thereabout. Attached to the loop members 46 are several stud members 50 that have upper ends 52 that are threaded and which extend above the V-shaped members 40.

A base plate 54 has appropriately spaced apertures for receiving the upper ends 52 of the stud members 50 and the base plate 54 is shaped to have a flat portion 56 and an upwardly protruding tab 58 at each end. A pair of conduit clearance apertures are also provided in the flat portion 56.

Since electrical power is usually required for the light standards 24, a conduit means is normally embedded in the barrier as illustrated in FIG. 3. A first conduit member 60 is laid upon the surface 14 and extends in the direction 62 to the next cage assembly, and a second conduit member 64 is laid on the surface 14 and extends in the direction 66 to the next cage assembly that is located in that direction. Similar conduit members are provided to interconnect spaced apart cage assemblies along the barrier 10. The first conduit member 60 has an end 68 and is bent so as to project the end 68 upwardly through one of the conduit clearing apertures in the base plate 54 as shown in FIG. 3. In like manner, the second conduit member 64 has an end 70 and is bent so as to project the end 70 upwardly through the other conduit clearing aperture in the base plate 54, as also is shown in FIG. 3.

In order to project the members from concrete during the forming operation, disposable covering caps 72 and covering caps 74 are placed respectively over the ends 52 of the stud numbers 50 and over the ends 68, 70 of the first and second conduit members 60, 64.

The above description of the cage assembly 32 has been included herein so that the construction and use of the present invention will be clear as the present discussion continues. The cage assembly 32, as described, may be constructed of rod stock and welded at attachment points as required to make the assembly adequate for the function of supporting the light standard 24. It should be kept in mind that the cage assembly 32 is the same whether the presently described invention is used or not. Conventionally, as pointed out above, the formed configuration 12 would first be constructed, leaving spaces at predetermined intervals for the construction of cage assemblies like the cage assembly 32 in each of the spaces. Once constructed, the barrier 10 is manually completed by filling in and about the cage assembly 32 with concrete so that the covered assembly with the formed configuration 12 appears to be an integrally formed barrier as shown in FIG. 1. Once the barrier 10 is completed, whether conventionally or by the apparatus of the present invention, the light standard 24 is mounted on the base plate 54 via bolting it to the stud members 50 and connecting the standard 24 to electrical lines that are positioned in the conduits 60 and 64.

The reason that manual finishing of the barrier 10 has been required in the past is that the cage assembly 32 presented an impassable object with the use of prior art apparatus that have been heretofor available to shape the concrete material or the like continuously over the cage assemblies. As will now be discussed, the present invention provides apparatus whereby the cage assemblies are first constructed in position, and then the present invention is used to continuously extrude all of the concrete required to form the barrier 10.

Figure 5:
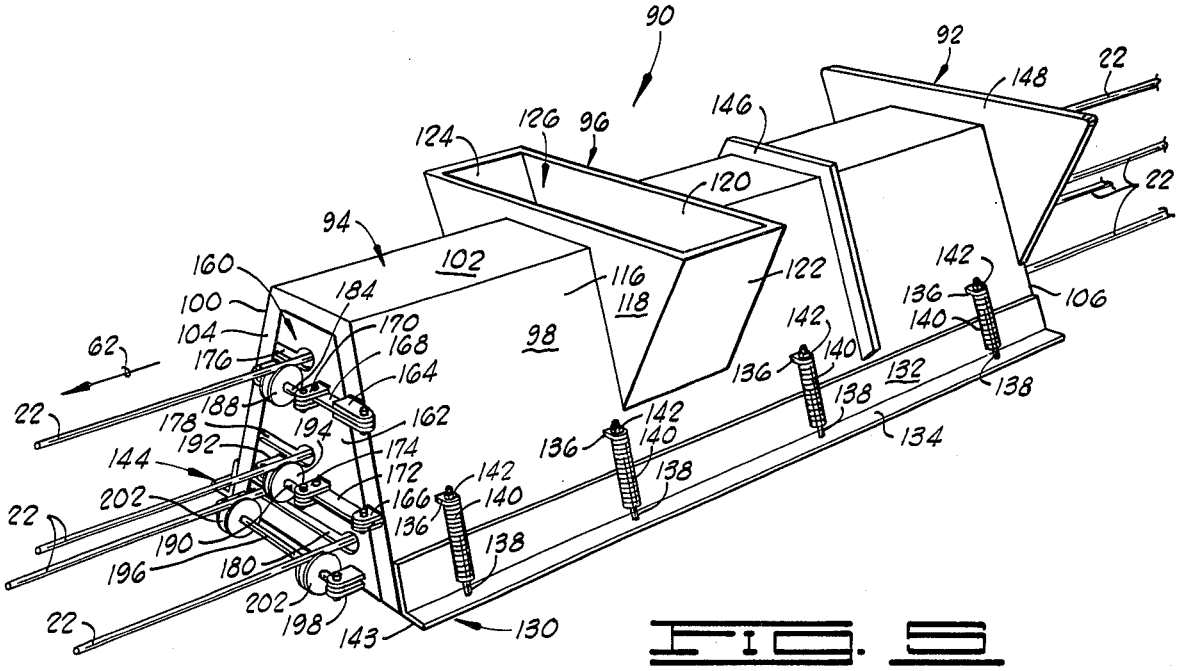
FIG. 5 shows a barrier forming assembly constructed in accordance with the present invention.

Turning now to FIG. 5, shown therein is a barrier forming apparatus 90 constructed in accordance with the present invention. The barrier forming apparatus 90 comprises a forming assembly 92 that is comprised of a concrete forming member 94 and a concrete passing member 96 constructed in the following manner. The concrete forming member 94 has a pair of slanted wall members 98 and 100 that are connected to and held in spaced part relationship by a top member 102. The concrete forming member 94 has a forward end 104 and a rearward end 106, and the wall members 98, 100, together with the top member 102, define a form cavity 108 that extends the length of the concrete forming member 94 and intersects the forward end 104 and the rearward end 106. As shown in the rear elevational view of the barrier forming apparatus 90 in FIG. 6, the form cavity 108 is open at the rearward end 106 for the extrusion of concrete in a manner that will become clear herein below. More specifically, the internal surfaces 110, 112 and 114 respectively of the wall member 98, the wall member 100 and the top member 102 define the form cavity 108, and it is these internal surfaces that serve to shape slip form concrete mix that is passed through the form cavity 108.

The concrete passing member 96 is a conduit member that is connected to and supported on the upper portion 116 of the concrete forming member 94 so as to intersect the wall members 98, 100 and the top member 102. The concrete passing member 96 has a pair of parallel wall members 118 and 120, and a pair of converging side wall members 122 and 124 that are interconnected as shown in FIG. 5 to form a concrete delivery opening 126 that has fluid communication with the form cavity 108 so that concrete is passable through the concrete delivery opening 126 to the form cavity 108.

The forming assembly 92 further comprises a first side skid member 130 that comprises a flat member 132 and a sliding tab member 134 that extends the length thereof. A plurality of apertured lugs 136 extend from the wall member 98, and an equal number of threaded stud members 138 extend from the tab member 134. The extensive end of each of the stud members 138 passes through one of the apertured lugs 136, and a spring 140 and a nut 142 are provided for each of the stud members so that the first side skid member is securely held to the wall member 98 as shown in FIG. 5. This arrangement holds the flat member 132 slidingly against the wall member 98, and the springs 140 bias the first side skid member in a surface engaging direction as the barrier forming apparatus 90 is supported on the surface 14. The tab member 134 has an underside surface 143 and is connected to the flat member 132 at an appropriate angle so that the underside surface 143 is generally flat against the surface 14 to provide a ground contacting wear surface.

Figure 6:
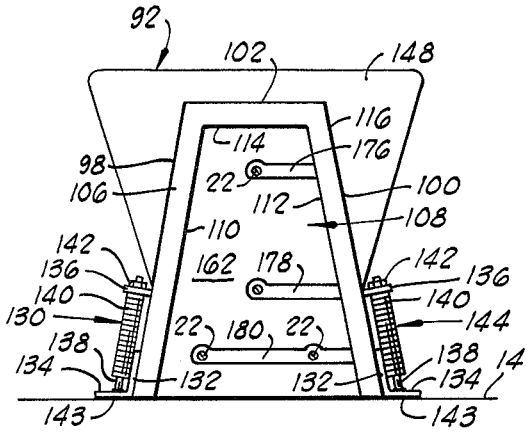
FIG. 6 and 7 respectively show elevational views of the rearward end and the forward end of the barrier forming apparatus of FIG. 5.
Figure 7:
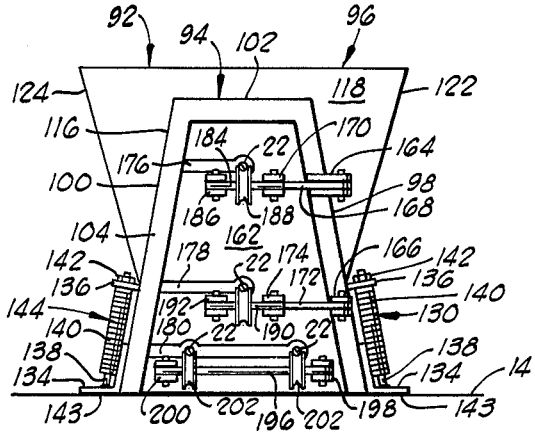

In like manner, a second side skid member 144 is connected to the other slanted wall member 100. As the second side skid member 144 is constructed identically to that of the first side skid member 130, and it is interchangeable therewith, it will not be necessary to provide a detailed description thereof. Rather, it will be sufficient for purposes of this disclosure to simply note that the construction is the same, and identical numbers are used in the drawings to reflect the corresponding components of the second side skid member 144. The springs 140 that are associated with the second side skid member 144 bias it in a surface engaging direction so that the underside surface 143 of the second side skid member is set to be positioned generally flat against the surface 14 as is best shown in FIGS. 6 and 7. The second side skid member 144 is slidingly held against the wall member 100, and together with the first side skid member 130, supports the barrier forming apparatus on the surface 14.

To this point in the discussion, it will be recognized that the barrier forming apparatus 90 is a slip form concrete extruder, and that the shape of the extrusion is governed by the shape of the forming cavity 108. Since concrete is such a dense material and the forces exerted on the barrier forming apparatus 90 are very great, a reinforcing member 146 is attached along the wall member 98, to the top member 102 and to the wall member 100, as shown in FIG. 5. Any number of such reinforcing members may be provided as required. For the same reason, another reinforcing member 148 is attached to the walls and top of the barrier forming apparatus 90 at the rearward end 106, which is the extruding end, to strengthen the wall members 98, 100 and the top member 102 to assure that the formed configuration 12 as it is extruded is exactly the shape of the form cavity 108.

The barrier forming apparatus 90 also comprises a forward end closing assembly 160 attached to the forward end 104 that serves as a positioning means for positioning the reinforcing rods 22 relative to the form cavity 108 and consequently relative to the transverse profile of the formed configuration 12 as the barrier forming apparatus 10 is formed. The forward end closing assembly 160, also referred to herein below as a door assembly, is comprised of a door member 162 that is shaped generally to conform to the outline of the form cavity 108 and is supported by a hinge 164 and a hinge 166 to block the form cavity 108 at the forward end 104 of the concrete forming member 94. The hinge 164 is supported by the end of the wall member 98 and is connected to the door member 162 via a strap 168 that is attached to a connector 170 that is in turn attached to the door member 162. The hinge 166 is also supported by the end of the wall member 98 and is connected to the door member 162 via a strap 172 that is attached to a connector 174 that in turn is attached to the door member 162.

Figure 8:
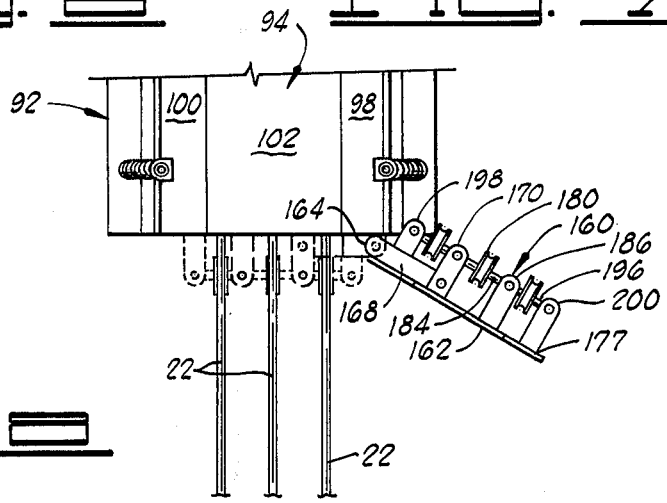
FIG. 8 is a plan view of the forward end of the barrier forming apparatus with the bar positioning apparatus pivoted outwardly to open the forward end of the form cavity.

This arrangement provides a means of selectively opening or closing the forward end 104. That is, the door member 162 has a closed position, as shown in FIGS. 5 through 7, wherein the door member 162 is positioned transversely to the form cavity 108 to block the form cavity 108 at the forward end 104. The door member 162 also has an open position, as shown in FIG. 8, wherein the door member 162 is pivoted clear of the form cavity 108. The broken lines in FIG. 8 depict the door member 162 in its closed position. Latching means (not shown) may be provided to secure the door member 162 in either of its positions.

The door member 162 has a rod clearance channel 176 that extends inwardly from the door edge 177 and is shaped to provide clearance for one of the reinforcing rods 22 as shown in FIGS. 5 through 7. Also, the rod clearance channel 176 permits the opening and closing of the door member 162 when its respective reinforcing rod is extending through the form cavity 108. In like manner, a rod clearance channel 178 and a rod clearance channel 180 are also provided for clearing the other reinforcing rods 22 as illustrated in FIGS. 5 through 7. The number of reinforcing rods and the spacing of the rods relative to the profile of the formed barrier will vary and the drawings show an arbitrary arrangement of four such reinforcing rods. It will be understood that the present invention is not intended to be limited to the depicted configuration and number of reinforcing rods.

The door member 162 may also be provided with a conduit clearance channel so that the door member 162 may be opened and closed over an electrical conduit such as represented by the first conduit member 60 shown in FIG. 2. However, a conduit clearance channel is not shown in FIGS. 5 through 7 in order to simplify the drawings.

The forward end closing assembly 160 further comprises a support shaft 184 that is supported at one of its ends via a pin and aperture therein by the connector 170, and the support shaft 184 is likewise supported at its other end by a connector 186 that is attached to the door member 162. A pulley member 188 is rotatingly supported by the support shaft 184, and the spacial position of the pulley 188 is selectively set so that it rollingly engages the reinforcing rod 22 that passes through the rod clearance channel 176 when the door member 162 is positioned in its closed position. In like manner, a support shaft 190 is supported by the connector 174 and a connector 192 that is attached to the door member 162, and a pulley member 194 is rotatingly supported by the support shaft 190 to rollingly engage the reinforcing rod 22 that passes through the rod clearance channel 178. Also, a support shaft 196 is supported at one of its ends by a connector 198 and its other end by a connector 200, the connectors 198, 200 being attached to the door member 162 near the rod clearance channel 180. A pair of pulley members 202 are rotatingly supported by the support shaft 196 so as each of the pulley members 202 rollingly engage one of the reinforcing rods 22 that pass through the rod clearance channel 180 as shown in FIGS. 5 and 7.

The above described arrangement provides for a means for positioning the reinforcing rods 22 relative to the transverse profile of the barrier 10 as it is being formed by the barrier forming apparatus 90. When the door member 162 is in its closed position, the support shaft 184, 190 and 196 are positioned transversely to the form cavity 108, wherein the respective pulley members 188, 194, and 202 rollingly engage and position the reinforcing rods 22 passing therethrough, in which position the support shafts 184, 190, and 196 and their respective pulley members are in a rod engage position. As the door member 162 is moved to its open position, the reinforcing rods 22 are cleared by the rod clearance channels 176, 178 and 180, and the support shafts 184, 196 and 198 with their respective pulley members are positioned in a non-engage position.

OPERATION OF THE PREFERRED EMBODIMENT

Prior to operating the barrier forming apparatus 90, the reinforcement cage assemblies 32 which are to be embedded in the barrier 10 are placed at the sites they are to occupy along the path of the barrier 10. The reinforcing rods 22 and the electrical conduit members, as represented by the first and second conduit members 60, 64, are laid along the predetermined path which the barrier 10 is to follow over the surface 14.

The barrier forming apparatus 90 is mounted on a drive apparatus such as, for example, the one described in U.S. Pat. No. 3,779,662, previously cited. The barrier forming apparatus 90 is then taken to the position at which the barrier 10 is to commence. The barrier forming apparatus 90 is lowered so that the first side skid member 130 and the second side skid member 144 are caused to engage the surface 14 upon which the barrier 10 is to be formed, and the door assembly 160 is placed in the engage, or closed, position. The reinforcing rods 22 are positioned over the pulley members 188, 194 and 202 so that the pulley members will guide the reinforcing rods 22 into the form cavity 108 as the drive apparatus is driven forward.

As the drive apparatus is driven forward and guided along the predetermined path, concrete is introduced into the form cavity 108 through the concrete passing member 96. The concrete is extruded from the rearward end 106 of the forming member 94 as the drive apparatus is driven along the predetermined path to form the barrier 10, the extruded concrete having the transverse configuration of the form cavity 108. The reinforcing rods 22 and electrical conduit members pass through the form cavity 108 and are incorporated into the barrier 10 as the latter is formed.

When the barrier forming apparatus 90 reaches a position near a reinforcement cage assembly 32, the driven apparatus is stopped and the introduction of concrete into the form cavity 108 is momentarily discontinued. The door assembly 160 is then moved to the open, or non-engage position, and the drive apparatus is driven forward until the reinforcement cage assembly 32 is contained within the form cavity 46. The drive apparatus is again stopped and the door assembly 160 is returned to the engage, or closed, position. The introduction of concrete into the form cavity 108 and the forward motion of drive apparatus are then resumed so that formation of the barrier 10, with the reinforcement cage assembly 32 embedded therein, is resumed.

After the barrier forming apparatus 90 has passed the location of the reinforcement cage assembly 32, excess concrete is removed from over the base plate 54 and the covering caps 72 and 74 are removed from the threaded ends 52 of the stud members 50 and from the electrical conduit ends 68, 70. The light standard 24 may be mounted to the threaded stud members 50 when the concrete has sufficiently cured.

It is clear that the present invention is well-adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

I claim:

1. In an apparatus for forming a continuous barrier on a surface, the barrier formed of concrete material or the like in which at least one continuous reinforcing rod is disposed to extend through the length of the barrier and in which reinforcement cages are disposed at predetermined intervals along the barrier, an improved concrete forming assembly comprising:

a concrete forming member having a forward end, an upper portion and a rearward end, the concrete forming member having a form cavity extending therethrough to intersect the rearward end and the forward end, the formed barrier being extruded from the rearward end of the concrete forming member when the concrete forming member is moved along the surface;

a concrete passing member supported on the upper portion of the concrete forming member and having a concrete delivery opening therethrough having a fluid communication with the form cavity, the concrete passing member disposed between the forward end and the rearward end of the concrete forming member; and a forward end closing assembly attached to the concrete forming member at the forward end thereof and comprising:

a door member pivotally attached to the forward end having a closed position wherein the door member is positioned transverse to, and in partial blocking relationship to, the form cavity, the door member having a rod clearance channel, and the door member having an open position wherein the door member is positioned clear of the form cavity, the clearance channel permitting the door member to clearingly pass the reinforcing rod; and rod positioning means supported by the door member for positioning and guiding the reinforcing rod through the rod clearance channel when the door member is in the closed position.

2. An improved apparatus for forming a continuous rod reinforced barrier of concrete or the like on a surface, the barrier having cage reinforced standard supports at predetermined intervals, the improved apparatus comprising:

a concrete forming member having a forward end, an upper portion and a rearward end, the concrete forming member having a form cavity extending the length thereof and intersecting the forward and rearward ends;

concrete passing means having fluid communication with the form cavity for passing concrete or the like to the form cavity whereby the barrier is extrudable continuously from the rearward end of the concrete forming member in an operational position in which the concrete forming member is caused to move over the surface; and a door assembly capable of partially sealing the forward end of the form cavity at the forward end of the concrete forming member, comprising:

at least one support shaft pivotally attached to the concrete forming member at the forward end thereof;

positioning means supported on the support shaft for guiding the rod reinforcement; and a door member attached to the shaft and positionable in a sealing position and in a clearing position relative to the form cavity, the cage reinforced standard supports passable through the form cavity when the door member is in the clearing position, the door member having a clearance channel permitting the door member to be selectively and clearingly pivoted between the sealing position and the clearing position.

3. In an apparatus for forming a continuous barrier of concrete or the like on a surface with at least one continuous reinforcing rod extending the length thereof, an improved barrier forming apparatus comprising:

forming means for forming the continuous barrier; the forming means characterized as comprising:

a concrete forming member having a forward end, an upper portion and a rearward end, the concrete forming member having a form cavity extending therethrough and intersecting the forward end and the rearward end; and a concrete passing member supported on the upper portion of the concrete forming member and having a concrete delivery opening therethrough having fluid communication with the form cavity through which concrete is passable to the form cavity, the formed barrier extrudable continuously from the rearward end of the concrete forming member in an operational position wherein the concrete forming member is moved over the surface; and positioning means attached to the forming means for positioning the reinforcing rod relative to the transverse profile of the barrier in a rod engage position thereof, and positionable in a non-engage position wherein the positioning means is disengaged with the reinforcing rod, the positioning means characterized as comprising:

a support shaft pivotally supported by the forward end of the concrete forming member and positionable transversely to the form cavity in the rod engage position, and the support shaft is positionable in the non-engage position to be clear of the form cavity;

a pulley rotatingly supported by the shaft and rollingly engageable with the reinforcing rod when the shaft is positioned in the engage position; and a door member attached to the support shaft having a rod clearance channel, the door member positioned in the engage position of the support shaft in partial sealing relationship to the form cavity, and the door member being positioned in the non-engage position of the shaft in clearing relationship to the form cavity, the rod clearance channel permitting the door member to be moved past the reinforcing rod as the support shaft is caused to be moved between the engage and the non-engage positions.

4. In an apparatus for forming a continuous barrier of concrete or the like on a surface with a plurality of continuous reinforcing rods extending the length thereof, an improved barrier forming apparatus comprising:

forming means for forming the continuous barrier, the forming means characterized as comprising:

a concrete forming member having a forward end, an upper portion and a rearward end, the concrete forming member having a form cavity extending therethrough and intersecting the forward end and the rearward end;

a concrete passing member supported on the upper portion of the concrete forming member and having a concrete delivery opening therethrough having fluid communication with the form cavity through which concrete is passable to the form cavity, the formed barrier extrudable continuously from the rearward end of the concrete forming member in an operational position wherein the concrete forming member is moved over the surface; and positioning means attached to the forming means for positioning the plurality of reinforcing bars relative to the transverse profile of the barrier in an engage position thereof, and positionable in a non-engage position wherein the positioning means is disengaged relative to the plurality of reinforcing rods, the positioning means characterized as comprising:

a plurality of support shafts pivotally attached to the forward end of the concrete forming member, each shaft positionable transversely to the form cavity in the engage position, and each shaft positionable in the non-engage position to be clear of the form cavity;

a plurality of pulleys rotatingly supported by the shafts and equal in number to the number of reinforcing rods, each pulley rollingly engageable with one of the reinforcing rods when the support shafts are positioned in the engage position; and a door member attached to the support shafts having a plurality of rod clearance channels, the door member positioned in the engage position of the support shafts in partial sealing relationship to the form cavity, the door member positioned in the non-engage position of the support shafts in clearing relationship to the form cavity, the rod clearance channels permitting the door member to be moved past the reinforcing rods as the support shafts are caused to be moved between the engage and the non-engage positions.

* * * * *